United States Patent [19]

Finch

[11] 4,397,210

[45] Aug. 9, 1983

[54] RHYTHM SOUND GENERATOR

[75] Inventor: Robert A. Finch, Mundelein, Ill.

[73] Assignee: CBS Inc., New York, N.Y.

[21] Appl. No.: 329,964

[22] Filed: Dec. 11, 1981

[51] Int. Cl.[3] ..... G10H 1/08; G10H 1/42; G10H 5/00

[52] U.S. Cl. ..... 84/1.03; 84/1.22; 84/DIG. 12

[58] Field of Search ..... 84/1.03, DIG. 12, 1.22

[56] References Cited

U.S. PATENT DOCUMENTS

| | | | |
|---|---|---|---|
| 3,493,667 | 2/1970 | Campbell | 84/1.03 |
| 4,181,059 | 1/1980 | Weber | 84/DIG. 12 |
| 4,198,891 | 4/1980 | Weber | 84/1.03 |

*Primary Examiner*—S. J. Witkowski
*Attorney, Agent, or Firm*—Spencer E. Olson

[57] ABSTRACT

An electronic circuit triggered by pulses derived from the rhythm pattern generator of an electronic organ simulates the sound of a group of people clapping hands by producing in bursts at least two different sound signals of differing characteristics and combining the signal bursts in a predetermined pattern which causes them to occur in close time proximity to each other but not at the same time. When the combined signal is acoustically reproduced, the resulting sound is simulative of that produced by a group of people clapping their hands in unison.

10 Claims, 5 Drawing Figures

RINGING CIRCUIT
260
WHITE NOISE GATE
262
264
RINGING CIRCUIT
232
ONE SHOT
212
ONE SHOT
216
TRIGGER FROM RPG
210
+5V
+12V
(a)
(b)
(c)
(A)
(B)
(C)
Q
Q̄
TRIGGER
≅ 120 MS
≅ 25 MS
≅ 25 MS
t1
t2
t3

RHYTHM SOUND GENERATOR

BACKGROUND OF THE INVENTION

This invention generally relates to electronic musical instruments, and, more particularly to electronic circuits for use in an electronic organ for simulating the sound produced by a group of people clapping hands.

During the evolutionary development of electronic organs, musical devices have been developed which automatically produce repetitive rhythms for accompaniment with the organ, and such rhythm pattern generators have, in turn, stimulated the development of electronic circuits for generating a variety of sounds, often spoken of as "instruments". Examples of such circuits are described in commonly assigned U.S. Pat. Nos. 4,181,059 and 4,198,891 for simulating the sound of a wire brush rotated around the head of a snare drum, and for simulating the sound of percussive instruments, such as a Tom Tom, respectively.

A sound typically and effectively used by groups who play country rhythm, gospel rhythm, and soul rhythm, an increasingly popular class of music, is that produced by a group of people clapping hands in tempo with the music. It having been found desirable to make this type of sound available in an electronic organ, as an adjunct to the many other "instruments" that have heretofore already been simulated by electronic means, it is the primary object of the present invention to provide an electronic circuit of modest cost for simulating the sound of a group of people clapping hands.

BRIEF DESCRIPTION OF THE INVENTION

Briefly, the rhythm sound generator according to the invention is intended for use in an electronic organ including a rhythm pattern generator which produces sequences of trigger pulses each characteristic of a particular rhythm, and one or more loudspeakers for acoustically reproducing electrical signals generated within the organ. The sound generator, in response to trigger pulses of a selected sequence, produces an electrical signal which when acoustically reproduced simulates the sound of a group of persons clapping hands in tempo with the selected rhythm. The circuit includes at least two sound signal circuits each operative to produce signal bursts of differing tonal characteristics in timed relationship to a trigger pulse and to each other, and means for combining the sound signal bursts and applying the combined signal to the loudspeaker for acoustic reproduction. One of the sound signals is gated white noise and one of the other sound signal circuits is a tone burst generator.

In a first and preferred embodiment the white noise signal is gated with a square wave envelope having very rapid attack and decay, another sound circuit generates a ring tone burst and a timing circuit triggers the two sources to cause the outputs to appear in a sequence consisting of a gated burst of white noise, followed by a ring tone burst of predetermined duration, in turn followed by two additional closely spaced gated bursts of white noise. A second embodiment includes a pair of ring tone generators which produce ring tone signals of different frequencies, the outputs from which are linearly combined with a gated white noise signal and under control of a timing circuit appear in a sequence consisting of an initial burst from one of the ring tone generators, followed after a predetermined time lapse by a burst from the second ring tone generator which, in turn, is closely followed by the gated white noise signal and a second burst from the second ring tone generator. Although the reproduced sounds from the two embodiments have somewhat different qualities, both realistically simulate the desired handclap sound.

BRIEF DESCRIPTION OF THE DRAWINGS

Other objects, features and advantages of the invention will become apparent, and its construction and operation better understood, from the following detailed description, taken in conjunction with the accompanying drawings, in which.

DESCRIPTION OF THE PREFERRED EMBODIMENTS

Essential to the design of an electronic circuit for simulating the sound of a group of people clapping hands is an understanding of what the handclap sound really is. It is not a single person clapping hands, but rather, a group of two, three or perhaps four people clapping in unison and in tempo with the music. However, not all of three or four people clapping in tempo will bring their hands together at exactly the same time as called for by the music; there will be slight differences in time between the actual beat and the times that all will have clapped their hands. Also, the pitch characteristics of the handclap sound will differ from person to person; some will be low pitched and others high depending on the physical structure of the hands and fingers, which parts of the hands meet first, the intensity of the clap, and many other factors. Room acoustics may also have an effect on the perceived tonal structure of the handclap sound.

In general, simulation of the differing times of strike and the differing pitch characteristics of the handclap sound produced by different people of a group is achieved with a sequence of closely following bursts of signals having at least two different pitch characteristics and acoustically reproducing the burst signal sequence. The sequences are initiated by and timed from trigger pulses from a rhythm pattern generator. One of the sound signals in the sequence is a white noise signal gated by a substantially square wave envelope which when reproduced produces a sound simulative of the handclap of one person, and when this signal is mixed with a sequence of ring tone bursts, the result of several persons clapping together, but not necessarily in exact unison with the tempo of the music, nor with each other, is realistically simulated. Inasmuch as any electronic simulation of a sound effect is quite subjective, and thus may be differently perceived by different listeners, an acceptably realistic simulation can be obtained with a variety of sequences of white noise and ring tone bursts; two circuit implementations which have produced acceptable results will be described.

Figure 1:
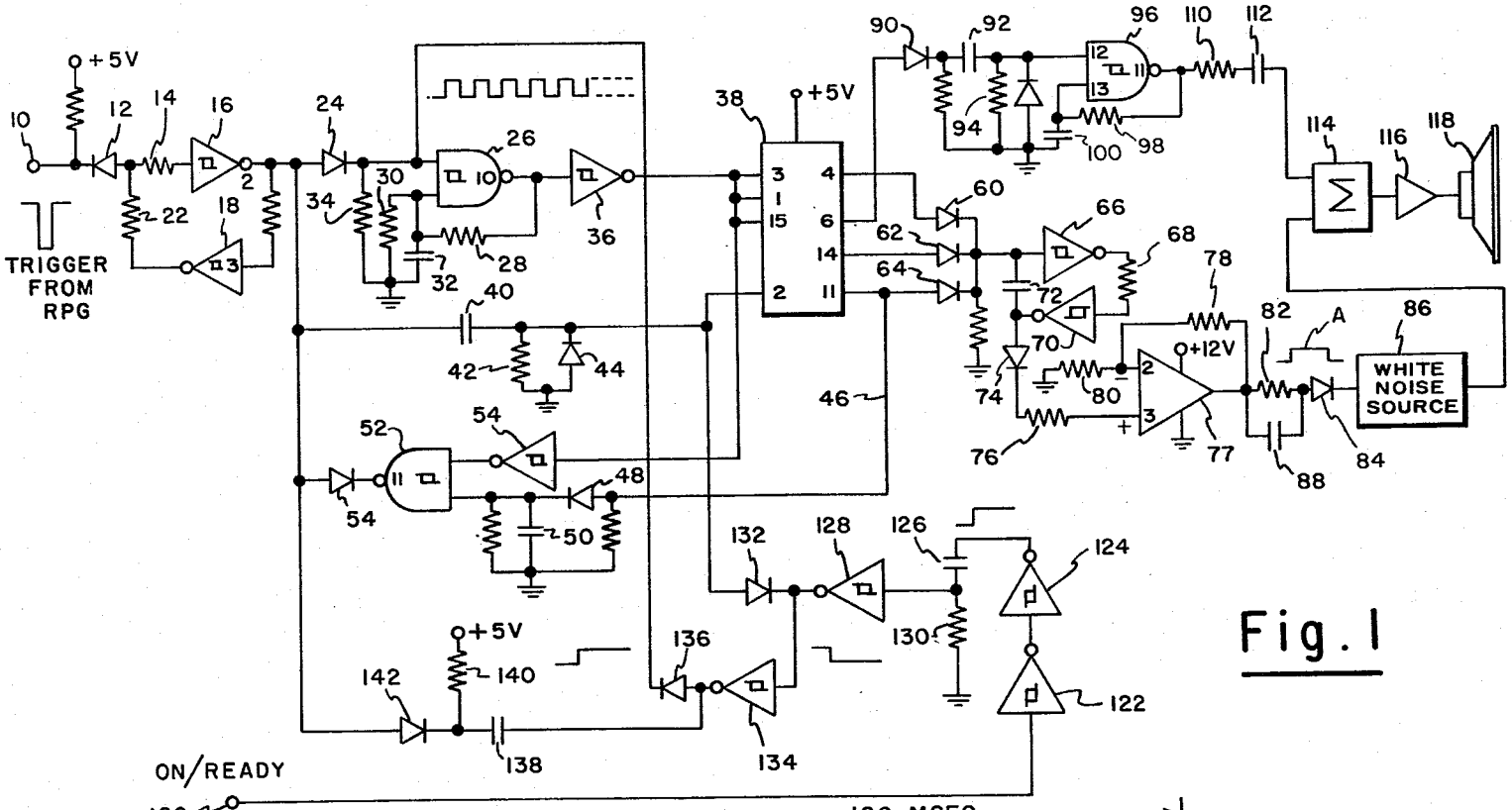
FIG. 1 is a circuit diagram of a first embodiment of a rhythm sound generator according to the invention.

Considering first the preferred embodiment of the invention illustrated in FIG. 1, the circuit is controlled by trigger pulses derived from the rhythm pattern generator (RPG) of the electronic organ in which the circuit is to be used, these pulses establishing the time in the rhythm pattern at which the handclap sound should occur. Typically, these are negative-going pulses having an amplitude of about 5 volts and a duration of approximately 25 microseconds, and are applied via an input terminal 10, a diode 12 and a resistor 14, typically having a value of 1K ohm, to the input of an inverting gate 16. Gate 16 may, for example, be one-half of a two-gate pair such as the 40106 Type CMOS Schmitt Trigger commercially available from RCA and others and is connected in a latch configuration with the other gate 18 of the pair; more particularly, the output of inverting gate 16 (pin 2 of the IC) is connected via a resistor 20 to the input of inverting gate 18, the output terminal of which, in turn, is connected through a resistor 22 of the same value as resistor 20, typically 10K ohms, to the junction of diode 12 and resistor 14. The negative-going trigger input causes the output terminal of gate 16 to go positive and to stay positive until a negative pulse is applied to the input of gate 18 (pin 3 of the IC) to reset the latch. Description of how the latch citcuit is reset will be deferred until later.

The positive potential produced at the output of gate 16 in response to a trigger pulse is applied through a diode 24 to one input of a two-input NAND gate 26 which may, for example, be one-fourth of an RCA-CD4093 type CMOS integrated circuit which consists of four Schmitt-trigger circuits, each of which functions as a two-input NAND gate with Schmitt-trigger action on both inputs. The output terminal of the gate (pin 10 of the IC) is connected via a resistor 28, typically having a value of 300K ohms, to the other input of the gate (pin 9); this pin is also connected through parallel-connected resistor 30 and capacitor 32 to ground, and the other input is also connected to ground through the resistor 34, typically having a value of 470K ohms. The described connections form a commonly used Schmitt-trigger oscillator which for the indicated circuit values generates a squarewave output signal consisting of pulses spaced apart about 7.5 milliseconds (that is, having a frequency of about 13 Hz) and, as will be seen, a sequence of eight pulses is generated in response to each trigger input. This result is obtained by terminating the normal freerunning operation of a once triggered Schmitt oscillator by applying, at the appropriate time, a negative-going signal to the other input of the NAND gate. If the first mentioned input to NAND gate 26 is high the circuit will oscillate; if it is low the circuit will not oscillate.

To achieve compatibility with the circuit to follow, the square wave pulses generated by the Schmitt oscillator are inverted by an inverting amplifier 36 and then applied to selected inputs of an 8-bit shift-and-store register 38, such as the RCA-CD4094 Type CMOS 8-stage shift-and-store bus register. This is an 8-stage serial shift register having a storage latch associated with each stage for strobing data from the serial input to parallel buffered 3-state outputs. The parallel outputs may be connected directly to common bus lines. Data is shifted on positive clock transitions, and the data in each shift register stage is transferred to the storage register when the strobe input (pin 1 of the IC) is high. Data in the storage register appears at the outputs whenever the output-enable signal (pin 15) is high. As used in the present application, clock pulses from the Schmitt oscillator are applied in parallel to the clock input (pin 3) the strobe input (pin 1) and the output-enable (pin 15). At each positive transition of the sequence of clock pulses applied to clock terminal 3 any data applied to the data terminal (pin 2) is clocked into one of the storage registers, successive transitions shifting that information one stage at a time, and at the same time stores in the first storage position new data applied to pin 2, until the register is full, in this case, upon application of eight clock pulses. The clock pulses also applied to the strobe input (pin 1) causes the signal to be latched internally to an output from the register, and each occurrence of the strobe causes information stored in the shift register to be strobed to an output terminal. Thus, the effect of applying the same pulse sequence to the clock, strobe and output-enable inputs of the device causes the outputs of the device to shift, latch and enable all at the same time so as to provide output pulses at selected outputs provided positive data in the form of a pulse of the same width as the clock pulses from oscillator 26 is applied to the data terminal of the IC (pin 2). By making a positive signal appear at the data terminal (pin 2) only at the time of the occurrence of the first clock pulse of a sequence from Schmitt oscillator 26, an output pulse is produced that shifts from one output terminal to the next but which occurs on only one output terminal at a time; that is, the pulse appears first at output 1 (pin 4), one clock pulse interval later at output 2 (pin 5), and so on in sequence until it appears at output 8 (pin 11), the output from the last register stage. The requisite data signal for achieving the desired result is derived by coupling the positive pulse produced at the output of gate 16 in response to an input trigger pulse through a time constant circuit comprising a capacitor 40 and a resistor 42 to the data input (pin 2) of the shift-and-store register 38. Typically, capacitor 40 has a value of 0.0015 microfarads and resistor 42 has a value of 32K ohms so that when the output of latch 16 goes high, a positive pulse having a period sufficiently long to last until the first clock cycle from oscillator 26 reaches the shift-and-store register, yet short enough to disappear before the second clock cycle arrives, is applied to the data input (pin 2) of the register. A diode 44 connected in parallel with resistor 42 prevents the time constant circuit from responding to the negative-going trailing edge of the positive pulse at the output of gate 16. Thus, it is seen that a positive bit of data has been inserted into the first stage of the register concurrently with, and only for the duration of, the first clock cycle applied to the clock input (pin 3), which data is then shifted in response to the clock pulses to the eight different output terminals of the register in sequence, the eighth to occur pulse producing an output at pin 11 of the IC.

When count eight is reached, the resulting positive (high) signal appearing at output pin 11 is applied via conductor 46 and a diode 48 to a storage capacitor 50 and to one input of a dual input NAND Schmitt-trigger 52, which may be the other half of the IC containing Schmitt-trigger 26. The clock pulses from Schmitt oscillator 26 are inverted by a suitable inverting amplifier 54 and applied to the other input of Schmitt-trigger 52. When both inputs are high, which can occur only on the 8th pulse of a sequence produced by triggered oscillator 26, a negative (low) appears at the output which is applied via a diode 54 to the input (pin 3) of gate 18, which resets the latch to its initial condition.

Summarizing the operation of the part of the circuit thus far described, an incoming trigger from the rhythm pattern generator sets the latch to its "on" condition which, in turn, starts the clock generator 26 which, however, is limited to eight output pulses per initiation through the operation of shift-and-store register 38 and the latch resetting circuit just described. Thus, the output of the triggered oscillator is a sequence of eight clock pulses, generated in response to and immediately following each trigger input from the RPG, and in response thereto the shift-and-store register produces eight output pulses in timed relationship with the clock pulses. The frequency of occurrence of the trigger pulses depends, of course, on the selected rhythm pattern, and, typically, would be spaced no more closely than about 100 to 150 milliseconds. As has been noted earlier, the pulses in the 8-pulse sequence generated by oscillator 26 are spaced apart by about 7.5 milliseconds and thus occupy approximately the first 60 milliseconds of the 100 to 150 millisecond interval between successive trigger pulses, as shown in FIG. 2.

Only four of the eight available outputs from shift-and-store register 38 are utilized to control the operation of a pair of sound signal generators (to be described) to produce a sound signal simulative of the handclap sound; in particular, only the first (pin 4), third (pin 6), fifth (pin 14) and eighth (pin 11) outputs are used in the manner now to be described. The first, fifth and eighth output terminals are connected through respective diodes 60, 62, and 64 to the input of an inverting gate 66, which may be one-half of a 40106 Type Schmitt-trigger, the output of which is connected through a resistor 68 to the input of another gate 70, which may be the other half of the IC containing gate 66, the output of which is applied via a capacitor 72 to the input of gate 66 to form a monostable multivibrator which is triggered on succesively by the first, fifth and eighth outputs of register 38, each time generating a positive pulse at the output of gate 70. These pulses are coupled via a diode 74 and a resistor 76 to the non-inverting input of an operational amplifier 77 which, for example, may be one-half of a 1458 Type operational amplifier. The output terminal of the amplifier is connected through a resistor 78 to the inverting input, which is also connected through a resistor 80 to ground; typically, operational amplifier 77 is energized from a 12 volt supply and resistors 78 and 80 have values of 4.7 Kohms and 1 Kohm, respectively. The resulting signal at the output of the amplifier is a positive square wave pulse (A); this is coupled via a resistor 82 and a diode 84 and gates on a white noise source 86. The pulse (A) has a duration of approximately 15 to 20 milliseconds, and as is depicted in FIG. 2, one such pulse is initiated by each of the first, fifth and eighth pulses of each clock sequence from oscillator 26. A capacitor 88 connected in parallel with resistor 82 slightly rounds the gate pulse (A) to make the gated white noise somewhat less piercing than would occur if the noise source were substantially instantaneously turned on and off, better to simulate the handclap sound. The noise source 86 may be of the type conventionally used in electronic organs for generating brush or other similar sounds and may take the form illustrated and described in commonly assigned U.S. Pat. No. 4,181,059, the disclosure which is hereby incorporated herein by reference, consisting of a backbiased PNP junction transistor having its base electrode connected to ground, its collector electrode unconnected, and its emitter electrode connected through a resistor to a source of positive potential. When the base-emitter junction of the transistor is operated with reverse bias sufficient to cause Zener or avalanche breakdown, the current flow through the junction is random due to the avalanche current multiplication effect, causing a white noise signal to appear at the emitter electrode.

The positive pulse that appears at pin 6 of register 38 in response to the third clock pulse is applied via a diode 90 and a time constant circuit comprising a capacitor 92 and a resistor 94 to one input of a dual-input NAND Schmitt trigger, such as the RCA 4093 Type, the output terminal of which (pin 11 of the IC) is connected via a resistor 98 to the other input of the gate, which is also connected through a capacitor 100, typically having a value of 0.1 microfarad, to ground. The thus-connected Schmitt trigger functions as a burst oscillator which is turned on by application of a positive pulse to one of its inputs and which oscillates for a short period of time determined by the time constant of capacitor 92 (typically having a value of 0.22 microfarads) and resistor 94, typically having a value of 1 megohm. Because of the extremely high input impedance of CMOS Schmitt triggers, typically on the order of tens of megohms, only a small timing capacitor is required to cause the oscillator to be enabled for a very short burst, say four or five cycles of operation, occurring at a frequency on the order of 1500 to 2000 Hz. Thus, the output of oscillator 96 is a very short burst of a square wave signal which, although having pitch definition, occurs for such a short period that it is difficult to audibly perceive the pitch. The output of the oscillator is coupled through a resistor 110 and capacitor 112 to a summing network 114 which linearly combines it with the bursts of white noise from source 86; the output signal from the summing device is suitably amplified in an amplifier 116 and processed along with other signals for reproduction in a loudspeaker 118 of the organ in which the circuit is incorporated.

Figure 2:
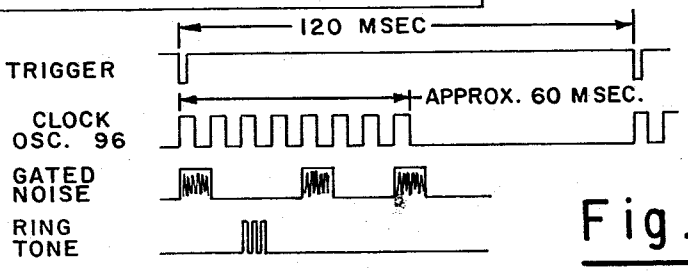
FIG. 2 is a timing diagram useful in explaining the operation of the circuit of FIG. 1.

Thus, as will be seen from the timing diagram of FIG. 2, for each trigger input the circuit delivers to the loudspeaker a combined signal consisting of a sequence of short signal bursts, commencing with a gated white noise burst of approximately 15 milliseconds duration followed after a period of about 15 milliseconds by a short burst of square wave signal (ring tone) which, in turn, is followed after 15 to 20 milliseconds by a second 15 millisecond burst of white noise, and after about 30 milliseconds by a third burst of white noise. This sequence of two different types of sound signal when acoustically reproduced gives a pleasing, realistic simulation of the sound of several persons clapping hands in unison. Repeating what has been said earlier, the test of any electronic simulation of a musical sound being very subjective, a sound that one listener perceives to be a correct simulation may not appear so to another listener; thus, for example, other investigators might find the result more pleasing and realistic if the white noise bursts were applied with somewhat different timing and/or in a different time relationship with the other sound signal. Also, although the described system uses a triggered Schmitt oscillator for generating the tone burst, this form having been selected primarily for ease of implementation, a similar effect can be obtained with the substitution of a ringing oscillator of comparable frequency for the triggered Schmitt oscillator.

To ensure that the operation will be as described when the power is first turned on, precaution is necessary to ensure that no positive data bits are contained in register 38, that the latches are set to their proper states, etc. To this end, following a settling time of 20 to 30 milliseconds after power is turned on, at which time the balance of the organ is ready to operate, the organ applied a positive signal to a normally low "on/ready" terminal 120. This positive voltage is applied through two serially-connected buffer amplifiers 122 and 124, such as the RCA-40106 Hex Schmitt Trigger, each circuit of which functions as an inverter; two stages are used solely for the purpose of obtaining a positive voltage for application to the circuit to follow. The positive voltage at the output of inverter 124 is applied to the plus terminal of a 2.2 microfarad electrolytic capacitor 126, the negative terminal of which is connected to the input of a Schmitt trigger gate 128 and also through a resistor 130 to ground. So long as the time constant of capacitor 126 and resistor 130 causes capacitor 126 to be charged approximately half way, the output of gate 128 (pin 10 of the IC), will be low, as indicated, and serves a number of functions. First, the low is coupled via a diode 132 to the data input terminal (pin 2) of shift-and-store register 38 which guarantees that no data can be applied to the register for so long as the data input is low regardless of whether pulses may be applied to the clock and strobe inputs. The output of gate 128 is also applied to the input of another buffer 134 (which may be on the same IC chip as buffer 128) which inverts the signal and applies the resulting positive signal through a diode 136 to the enable gate of NAND trigger 26 which guarantees generation of clock pulses for so long as the positive voltage is maintained; typically, the time constant C126 R130 maintains a sufficiently high positive level at the input of trigger gate 128 for a period of 100 milliseconds or more. The positive voltage at the output of gate 134 is also applied through a capacitor 138, typically having a value of 0.1 microfarads, and a resistor 140, typically having a value of 10 Kohms, to a source of +5 volts; the junction of capacitor 138 and resistor 140 is connected via a diode 142 to the reset terminal of the input latch, that is, the input terminal of gate 18.

When the initially charged time constant circuit R130 C126 has discharged to a level at which gate 128 is triggered off, its output terminal goes positive, which has the effect of taking diode 132 out of the circuit and thereby enable the data input terminal of register 38. At the same time, the output terminal of gate 134 goes low, taking diode 136 out of the circuit and thereby disabling clock generator 26 until such time as there is a trigger input pulse. Also, when the output of gate 134 goes low, the differentiating action of capacitor 138 and resistor 140 applies a negative pulse via diode 142 to the input of gate 18 which resets the latch and readies it for application of a trigger pulse.

Summarizing the just-described operation, the positive signal applied to the "on/ready" terminal 120 causes clock 26 to run for a considerable period of time, and at the same time disables the data input to register 38, thereby ensuring that data cannot be applied to the register and clearing out any data that may have been contained in the register, so that all of the register outputs are zero, and after a period determined by the time constant of capacitor 126 and resistor 130, the input latch is reset to be ready to receive the first trigger pulse.

Figures 3, 4, 5:
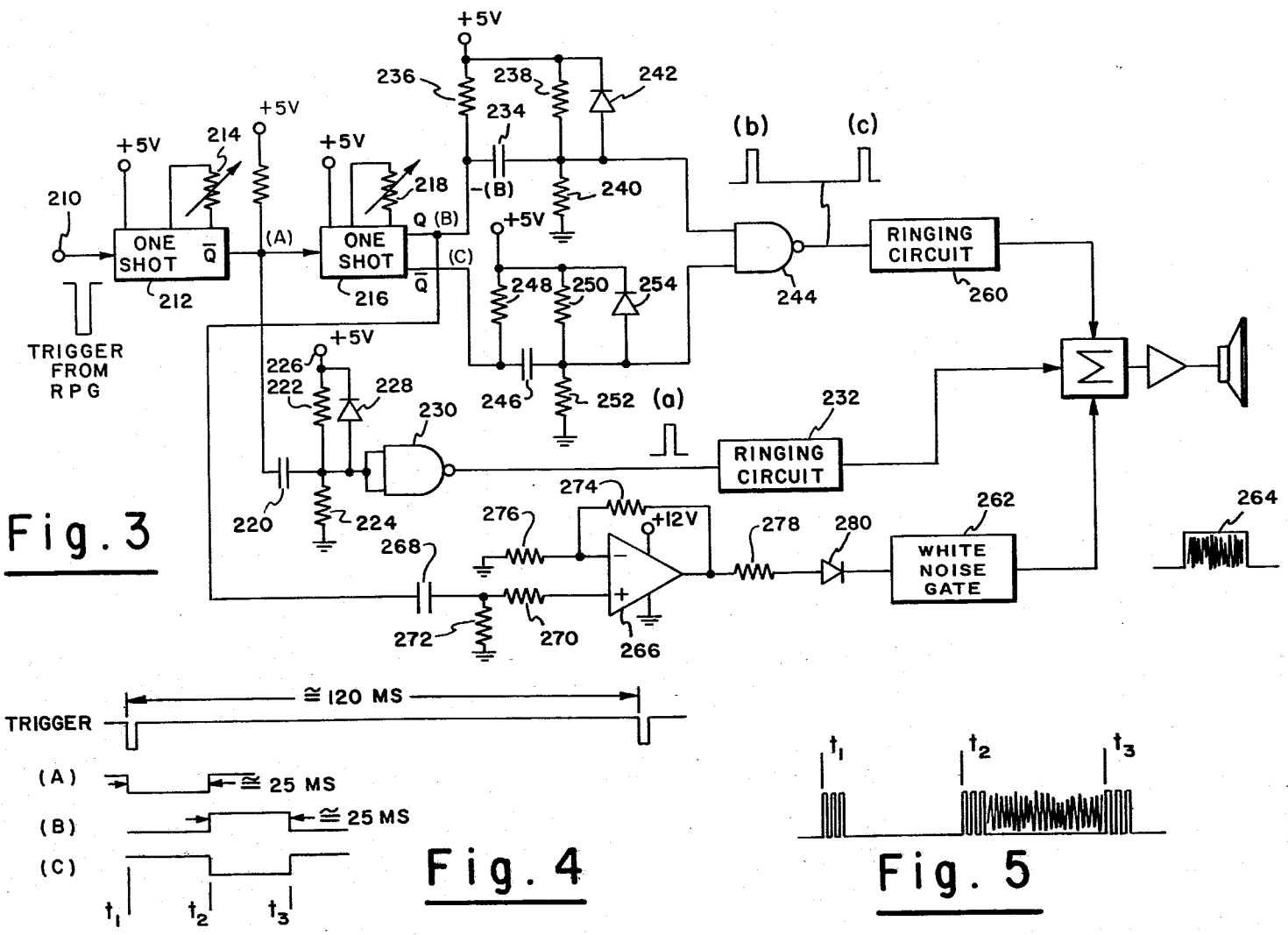
FIG. 3 is a circuit diagram of second embodiment of the rhythm sound generator.
FIG. 4 is a timing diagram useful in explaining the operation of the circuit of FIG. 3.
FIG. 5 is a diagram illustrating the characteristics of the output signal produced by the circuit of FIG. 3.

FIG. 3 illustrates another embodiment of the rhythm sound generator which utilizes a different form of timing circuit and also a different combination of burst signals for simulating the handclap sound. As in the FIG. 1 embodiment, operation of the circuit is initiated by pulses derived from the rhythm pattern generator which establish the time in the rhythm pattern a handclap sound should occur. Typically, the trigger pulses are short negative-going pulses having a duration of about 25 microseconds and an amplitude of approximately 5 volts, and in this embodiment are applied via an input terminal 210 to the input terminal of a monostable multivibrator 12, commonly known as a "one-shot", which includes a variable resistor 214 for adjustably controlling the duration of pulses produced at its output terminals. For reasons that will appear presently, the multivibrator is adjusted to produce at its $\overline{Q}$ output a rectangular pulse (A) having a duration of approximately 25 milliseconds and a falling leading edge in time coincidence with the falling edge of the trigger pulse, as shown in FIG. 4.

The positive-going trailing edge of the output pulse from "one-shot" 212 is used in two ways: (1) to fire a second monostable multivibrator 216, which also has a variable resistor 218 for adjustably controlling the duration of its output pulses, and (2) to initiate operation of a first of at least two tone burst generating circuits. Considering the latter function first, pulse (A) is differentiated by a network including a capacitor 220 and resistors 222 and 224 serially connected in that order between a source of positive potential, represented by terminal 226, and ground, and a diode 228 connected in parallel with resistor 222 for preventing any positive-going differentiated spike from exceeding the supply voltage and damaging the circuit (usually in integrated form). The signal developed at the junction of resistors 222 and 224 is applied to both inputs of a two-input NAND gate 230 which produces at its output a positive-going pulse (a), the leading edge of which is in time coincidence with the leading or falling edge of pulse (A); the values of resistors 222 and 224 and capacitor 220 are chosen to cause the duration of pulse (a) to be approximately 25 microseconds. It will be understood that a similar result could be achieved by replacing NAND gate 30 with a simple inverting gate; because NAND gates are especially suited in other parts of the circuit and several are normally available on a single integrated circuit chip, it was found convenient to use one for the inverter function. The pulse (a) is fed to and triggers a ringing circuit 232, which may be a triggered ringing oscillator of the type described in commonly assigned U.S. Pat. No. 4,198,891 which produces an oscillating output signal which decays in amplitude with time; in the present embodiment, the frequency-determining components of the ringing oscillator are selected to generate a ring tone signal burst having a frequency of approximately 2500 Hz and a duration of approximately 2.5 milliseconds which, when acoustically reproduced, gives a sound simulative of that produced when two pieces of wood are struck together and, by appropriate adjustment of the Q of the ringing circuit, the result is a narrow band ringing noise simulative of a click or snap, one of the sound constituents of the handclap sound.

Reverting now to one-shot 216, the output pulses (B) and (C) produced at its Q and $\overline{Q}$ outputs, respectively, are separately differentiated by circuits identical to that just described for differentiating pulse (A). Specifically, pulse (B), which has a positive-going leading edge, is differentiated by the circuit consisting of capacitor 234, resistors 236, 238 and 240, and a protective diode 242 connected in parallel with resistor 238. As before, the values of the differentiating circuit components are such as to produce an output pulse of approximately 25 microseconds duration for application to one of the inputs of a two-input NAND gate 244. The opposite polarity pulse (C) from one-shot 216 is differentiated by an identical circuit comprising capacitor 246, resistors 248, 250 and 252, and a protective diode 254, and the resulting negative-going output pulse of approximately 25 microseconds duration is applied to the second input of NAND gate 244. By virtue of the differentiation of the opposite polarity pulses from one-shot 216, NAND gate 244 produces a positive-going output pulse when either of its input terminals is pulled negative; thus, NAND gate 244 functions as an inverted OR in that a negative input to either input terminal produces a positive output. Consequently, the positive-going pulse (b) at the output of gate 244 occurs in substantial time coincidence with the falling leading edge of waveform (C), and pulse (c) occurs approximately 25 milliseconds later, in time coincidence with the falling trailing edge of pulse (B). The pulses (b) and (c) which occur at times $t_2$ and $t_3$, respectively, in the timing diagram of FIG. 4, are applied to and successively trigger a second tone burst generator 260, which may be another triggered oscillator of the type described above; thus, circuit 260 produces two time-separated short bursts of decaying sinusoidal signals each having a duration of approximately 2.5 milliseconds. The frequency of the tone bursts generated by circuit 260 is near but not the same as the frequency of oscillator 232, and is subject to some adjustment to achieve the desired handclap sound.

The positive-going rectangular pulse from the Q output of one-shot 216 is also utilized to activate a "white noise" gate 262, the output of which is a gated envelope of white noise as shown at 264. Because the gate 262 utilized in this embodiment was designed for 12 volt control input whereas the described pulse generating circuitry is energized from a 5 volt supply, it was necessary to apply pulse (B) to a voltage level translator, which includes an operational amplifier 266; pulse (B) is applied to the non-inverting input of the amplifier via a capacitor 268 and resistors 270 and 272. The gain of the amplifier is set by the relative values of resistors 274 and 276, the junction of which is connected to the inverting input, to be greater than that required to amplify the 5 volt input signal to a 12 volt output level. Capacitor 268, which preferably is of the electrolytic type to prevent leakage current, has sufficiently high capacitance to pass essentially the entire pulse signal; the resulting signal at the output of the amplifier, a pulse having essentially the duration of pulse (B), is coupled via a resistor 278 and a diode 280 to turn on a white noise gate 262 for approximately 25 milliseconds. The white noise source may be of the type described above in connection with the circuit of FIG. 1.

The gated burst of white noise, which is initiated at time $t_2$ (FIG. 4), is linearly mixed with the tone signals from ringing circuits 232 and 260, and the combined signal is amplified in a suitable power amplifier 282 and applied to one of the loudspeakers 284 of the electronic organ for acoustic reproduction. There is no intentional distortion of any of the signals in the combining process, although there may be some generation of sidebands by intermodulation of the pitches of the ringing circuits. It will be seen from FIG. 5, which roughly illustrates how the combined signal might look on an oscilloscope, that it consists of a sequence of signal bursts, first a tone burst of approximately 2.5 milliseconds duration from ringing circuit 232, a period of silence of approximately 25 milliseconds, a first 2.5 milliseconds tone burst from ringing circuit 260 immediately followed by the gated white noise signal, the latter continuing until time $t_3$ at which a second 2.5 milliseconds burst from ringing circuit 260 occurs. The presence of the white noise signal between the final two bursts has the effect of "spreading" the sound of the acoustically reproduced high frequency bursts so as to create the perception of there being more signals than actually is the case. It is thought that mixing in the ears of the random white noise with the time-separated short bursts of ring tone signals having a definable pitch may be responsible for the perception of many things happening at the same time and to realistically simulate, when played in context with a rhythm pattern, the sound produced by a group of several persons clapping hands in unison.

Although in the described example both of one-shots 212 and 216 generate output pulses of approximately 25 milliseconds duration, it is within the contemplation of the invention to make the periods between $t_1$ and $t_2$ and between $t_2$ and $t_3$ unequal, the amount of difference being subject to empirical determination by subjective listening tests. For example, the initial period desirably may be 30 milliseconds and the other period, during which the white noise occurs, may be 20 milliseconds. Further, while the described embodiment has two ringing circuits which produce tone bursts of differing frequencies, it is within the contemplation of the invention to use a different number of ringing circuits, for example as few as one and as many as three or four, the initiation of which is so timed relative to each other and to the white noise gate as to generate a combined signal which when acoustically reproduced acceptably simulates the handclap sound. Moreover, although a specific arrangement of multivibrators and gates has been described for controlling the timing relationship between the ringing circuits and the white noise gate, it will now be evident to ones skilled in the art that the objectives of the invention can be accomplished with other forms of timing circuits.

I claim:

1. For use in an electronic organ including a rhythm pattern generator which produces sequences of trigger pulses, each sequence characteristic of a particular rhythm, and a loudspeaker for acoustically reproducing electrical signals generated within the organ, an electronic circuit for producing an electrical signal which when reproduced by the loudspeaker simulates the sound produced when a group of persons clap hands substantially in unison, said circuit comprising:

timing circuit means connected to receive a selected sequence of trigger pulses from said rhythm pattern generator for producing a group of trigger signals in timed relationship to each trigger pulse in the said selected sequence and to each other, at least first and second sound signal sources for respectively producing in response to an applied trigger signal first and second signal bursts of differing tonal characteristics, said first sound signal source comprising a source of random noise, means for applying at least one trigger signal of the said group to each of the sound signal sources for causing said sound signal sources to produce a group of signal bursts of differing tonal characteristics in timed relationship to each trigger pulse in the said selected sequence and to each other, means for combining the signal bursts produced by the said at least first and second sound signal sources and producing said electrical signal and means for applying said electrical signal to the loudspeaker.

2. The electronic circuit according to claim 1, wherein said second signal source is a circuit for producing a first ring tone signal having a selected frequency.

3. The electronic circuit according to claim 2, wherein said timing circuit is operative in response to each trigger pulse in the selected sequence from the rhythm pattern generator to trigger said first and second sound signal sources to produce a combined signal comprising a first burst of random noise followed after a predetermined time interval by a burst of first ring tone signal, which is in turn followed by second and third spaced apart bursts of random noise.

4. The electronic circuit according to claim 3, wherein said source of random noise is a source of white noise.

5. The electronic circuit according to claim 2, wherein said second signal source is a gated oscillator.

6. The electronic circuit according to claim 3, wherein said bursts of random noise each have a duration of about 15 milliseconds, wherein said burst of ring tone signal follows the first burst of random noise by about 15 milliseconds, wherein the second burst of random noise follows the ring tone signal by about 15 to 20 milliseconds, and wherein the third burst of random noise follows the second by about 30 milliseconds.

7. The electronic circuit according to claim 2, wherein said circuit further includes a third sound signal source for producing a second ring tone signal differing in frequency from said first ring tone signal, and wherein said timing circuit is operative in response to each trigger pulse in the selected sequence from the rhythm pattern generator to trigger said first, second and third sound signal sources for producing a combined signal comprising a ring tone signal burst from said second signal source followed after a first predetermined time interval by a first ring tone signal burst from said third signal source, which is in turn immediately followed by a burst of random noise of predetermined duration which is in turn immediately followed by a second ring tone signal burst from said third signal source.

8. The electronic circuit according to claim 7, wherein said source of random noise is a white noise source.

9. The electronic circuit according to claim 7, wherein said second and third sound signal sources are ringing oscillator circuits.

10. The electronic circuit according to claim 7, wherein said bursts of ring tone signal each have a duration of approximately 2.5 milliseconds, wherein said first predetermined time interval is in the range from about 25 milliseconds to about 30 milliseconds, and wherein the duration of the random noise burst is in the range from about 25 milliseconds to about 20 milliseconds.

* * * * *